US005436711A

United States Patent [19]

Hauser

[11] Patent Number: 5,436,711

[45] Date of Patent: Jul. 25, 1995

[54] MULTILEVEL FUSING APPARATUS

[75] Inventor: Oscar G. Hauser, Rochester, N.Y.

[73] Assignee: Xerox Corporation, Stamford, Conn.

[21] Appl. No.: 158,350

[22] Filed: Nov. 29, 1993

[51] Int. Cl.[6] ..... G03G 15/20

[52] U.S. Cl. ..... 355/290; 355/282; 355/284; 355/285

[58] Field of Search ..... 355/282, 284, 285, 289, 355/290, 295, 208, 204; 219/216; 118/60

[56] References Cited

U.S. PATENT DOCUMENTS

| | | | |
|---|---|---|---|
| 3,965,331 | 6/1976 | Moser et al. | 219/216 |
| 4,218,499 | 8/1980 | Shinohara et al. | 118/60 X |
| 4,223,203 | 9/1980 | Elter | 219/216 |
| 4,242,566 | 12/1980 | Scribner | 219/216 |
| 4,315,682 | 2/1982 | Parzanici . | |
| 4,391,509 | 7/1983 | Cavagnaro | 219/216 X |
| 4,526,459 | 7/1985 | Bresnick | 355/3 |
| 4,639,405 | 1/1987 | Franke | 430/124 |
| 4,791,447 | 12/1988 | Jacobs . | |
| 4,928,147 | 5/1990 | Baumann et al. | 355/288 |
| 4,966,464 | 10/1990 | Matoushek | 346/76 |
| 4,973,824 | 11/1990 | Ohashi et al. | 219/216 |
| 5,087,947 | 2/1992 | Torino | 355/290 |
| 5,124,755 | 6/1992 | Hediger | 355/285 |
| 5,239,348 | 8/1993 | Fukuchi et al. | 355/282 |

*Primary Examiner*—A. T. Grimley
*Assistant Examiner*—Sandra L. Brase
*Attorney, Agent, or Firm*—Don L. Webber

[57] ABSTRACT

An apparatus for fusing toner to a surface of a sheet which includes tandem sets of heated and pressure rollers. A screw drive, solenoid or other means is used to urge the roller sets to make uniformly distributed contact on the sheet passing between the heated and pressure rollers. Each set of rollers may be selectively employed so as to vary temperature, dwell time, pressure and other performance parameters at the fusing nips of the sets of heated and pressure rollers. The path of a sheet moving through the fuser need not be altered to employ the varied fusing performance combinations, also reducing the likelihood of sheet jamming and misfeed. Fuser oil applicators may also be employed so as to apply oil to each heated roller as it engages the sheet.

31 Claims, 6 Drawing Sheets

MULTILEVEL FUSING APPARATUS

The present invention relates to a developed image fusing electronic reprographic image forming apparatus, and more particularly to a multilevel fuser for fixing toner to a sheet at varying temperatures, pressures and dwell times.

In electrophotographic applications such as xerography, a charge retentive photoreceptor belt is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to record an electrostatic latent image on the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contacting it with a finely divided electrostatically attractable toner. The toner is held in position on the photoreceptor image areas by the electrostatic charge on the surface. Thus, a toner image is produced in conformity with a light image of the original being reproduced. Once each toner image is transferred to a substrate, the image is affixed thereto so as to form a permanent record of the image to be reproduced. Particularly in the case of multicolor copiers and printers, the task of fixing the toned image to the sheet may be complex, as four or more layers of toner may be transferred to widely varying substrate sheets (plain paper, cover stock, transparencies, etc.) so as to achieve different matt and gloss finishes. As the single or multicolored toner is applied to the substrate, different temperatures, pressures, and/or dwell times may be required to attain the characteristics and image quality to create the single or multicolor copy or print.

Various approaches have been employed to fuse the toner image to the sheet in a copying or printing machine, including the following disclosures that may be relevant:

- U.S. Pat. No. 5,124,755 Patentee: Hediger Issued: Jun. 23, 1992
- U.S. Pat. No. 4,966,464 Patentee: Matoushek Issued: Oct. 30, 1990
- U.S. Pat. No. 4,928,147 Patentee: Baumann et al. Issued: May 22, 1990
- U.S. Pat. No. 4,791,447 Patentee: Jacobs Issued: Dec. 13, 1988
- U.S. Pat. No. 4,639,405 Patentee: Franke Issued: Jan. 27, 1987
- U.S. Pat. No. 4,526,459 Patentee: Bresnick Issued: Jul. 2, 1985
- U.S. Pat. No. 4,315,682 Patentee: Parzanici Issued: Feb. 16, 1982
- U.S. Pat. No. 4,223,203 Patentee: Elter Issued: Sep. 16, 1980
- U.S. Pat. No. 3,965,311 Patentee: Moser et al. Issued: Jun. 22, 1976

U.S. Pat. No. 5,124,755 to Hediger discloses an improved fixing assembly for fixing toners or the like on a receiving medium. The fixing assembly has a mechanical wide nip formed by a pair of nip forming belts with at least one of the belts being formed by multiple overlapping loops of cold rolled stainless steel. The ends of the stainless steel are secured to the loop adjacent to each end of the stainless steel. The stainless steel flexible formed belt may be coated and heated. Each belt is driven by a pair of internal friction drive rollers with the drive rollers being driven by a toothed belt engaging the drive rollers. The width of the nip is adjusted by changing the center distance between the friction drive rollers of the flexible belts.

U.S. Pat. No. 4,966,464 to Matoushek discloses an fusing device for a thermal transfer printer having a print system for producing a receiver sheet bearing a transferred dye image. The fusing device includes a fuser drum comprising a heat conducting rigid cylinder shell portion and three roller assemblies constructed to rotate on parallel axles at different locations around the periphery of the drum so as to constrain the path of drum rotation. One roller assembly is coupled to a rotary drive, and one is mounted for displaceable movement toward and away from the drum and resiliently urged toward the drum.

U.S. Pat. No. 4,928,147 to Baumann et al discloses a two fuser station system with one station positioned to fuse the image on one side when duplex copying or printing is selected. The other fuser station performs fusing when simplex copying is selected but fuses the second side copy for duplexing. When flash lamps are employed for the fuser station, the lamps are composed of multiple bays with a single power source coupled to each bay in sequence so that the power source size need only accommodate the power level demand of one bay. The time between trigger pulses is extended by commencing fusing with an intermediate bay followed by the initial bay and then the final bay as the image area requiring fusing passes along its path in proximity to the faces of the flash lamp bays.

U.S. Pat. No. 4,791,447 to Jacobs discloses a heat and pressure fusing apparatus for fixing color toner images to various types of copy substrates. The apparatus includes three roll members (one pressure roll and two heated rolls) which cooperate to form a pair of nips. All substrates pass through a first nip and a deflector plate directs certain types of substrates through the second nip. Passage of the substrates through the first nip causes the images carried thereon to contact a conformable elastomeric surface while passage through the second nip causes them to contact a relatively rigid surface. Thus, glossy and matt color copies on substrates such as plain paper and high chroma transparencies are suitably produced in a color reproduction apparatus incorporating this fuser. Matt color copies are produced by passing the substrate through only the first nip while glossy color copies and high chroma transparencies are produced by passing the substrates through both nips.

U.S. Pat. No. 4,629,405 to Franke discloses a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

U.S. Pat. No. 4,526,459 to Bresnick discloses a fusing system for fusing toner images to copy sheets having two rolls each in contact with a third roll; the first and second rolls each form nips with the third roll. Dual paper paths are provided with a first feed means for feeding copy sheets to the first nip and a second feed means for feeding copy sheets to the second nip.

U.S. Pat. No. 4,315,682 to Parzanici discloses a fuser roller apparatus in a toner fixing station associated with an electrophotographic or xerographic device for fixing a toner image onto a copy sheet by the application of heat and pressure. The fusing apparatus includes a heated fuser roll and a pair of smaller, spaced backup rolls, each of the backup rolls having a peripheral surface covering of a different elastic modulus from the other. The backup rolls are arranged so as to cooperate with the heated fuser roll to define two fusing nips through which a copy sheet sequentially passes. The downstream roll has the harder peripheral surface covering. As the copy sheet passes through the two nip areas in succession, the downstream backup roll tends to pull against the upstream backup roll. Thus, the copy sheet is tensioned as it passes over the portion of the surface of the heated fuser roll between the two backup rolls.

U.S. Pat. No. 4,223,203 to Elter discloses a heat and pressure fusing apparatus for fixing toner images to copy substrates comprising a first fusing system consisting of two fixed pairs of nip forming rolls. One of which is a conformable outer surface roll and the second nip has a roll with a rigid outer surface. Copy substrates pass through both nips such that the toner images sequentially contact the conformable outer surface and then the rigid outer surface.

U.S. Pat. No. 3,965,311 to Moser et al. discloses fuser assembly having three rolls forming a pair of fusing nips; the substrates pass in order to fuse the toner images to the substrate. A belt transport mechanism is provided for conveying the substrates to one or the other of the nips depending upon the particular material of the substrate.

In accordance with one aspect of the present invention, there is provided an apparatus for fusing a single toner image or a plurality of toner images on a sheet, including a first heated roller, a first pressure roller, a second heated roller and a second pressure roller. The apparatus further includes a translating member, responsive to the single toner image being on the sheet, positioning the first heated roller and the first pressure roller to define a first nip through which the sheet having the single toner image thereon passes with the second heated roller and the second pressure roller being spaced apart from one another, the translating member, responsive to the plurality of toner images being in the sheet, positioning the first heated roller and the first pressure roller to define the first nip and the second heated roller and the second pressure roller to define a second nip with the sheet having the plurality of toner images thereon passing through the first nip and the second nip.

The invention will be described in detail with reference to the following drawings, in which like reference numerals are used to refer to like elements. The various aspects of the present invention will become apparent as the following description proceeds and upon reference to the drawings, in which.

Figure 1:
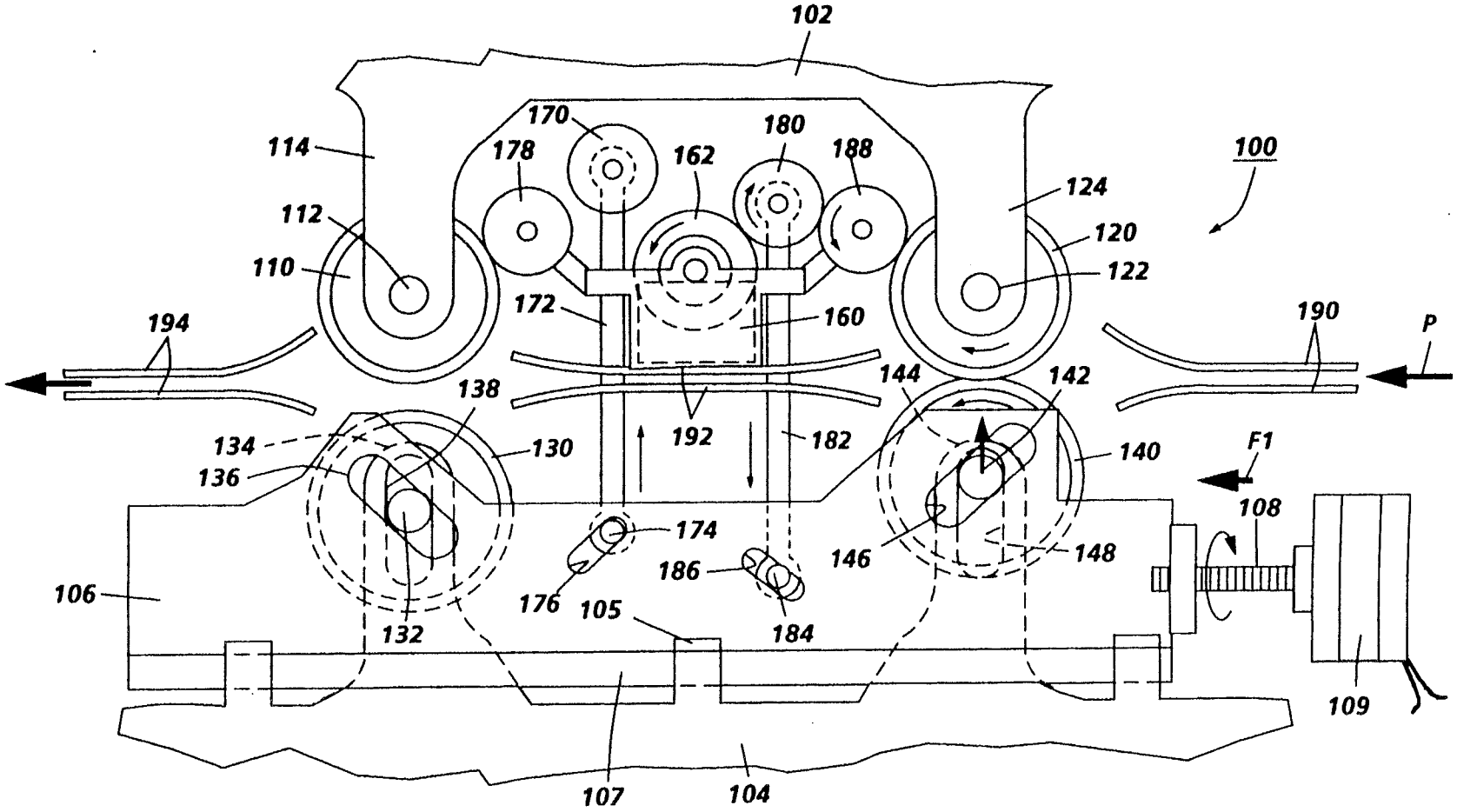
FIG. 1 is an elevational view of the fusing assembly of the present invention.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

Figure 6:
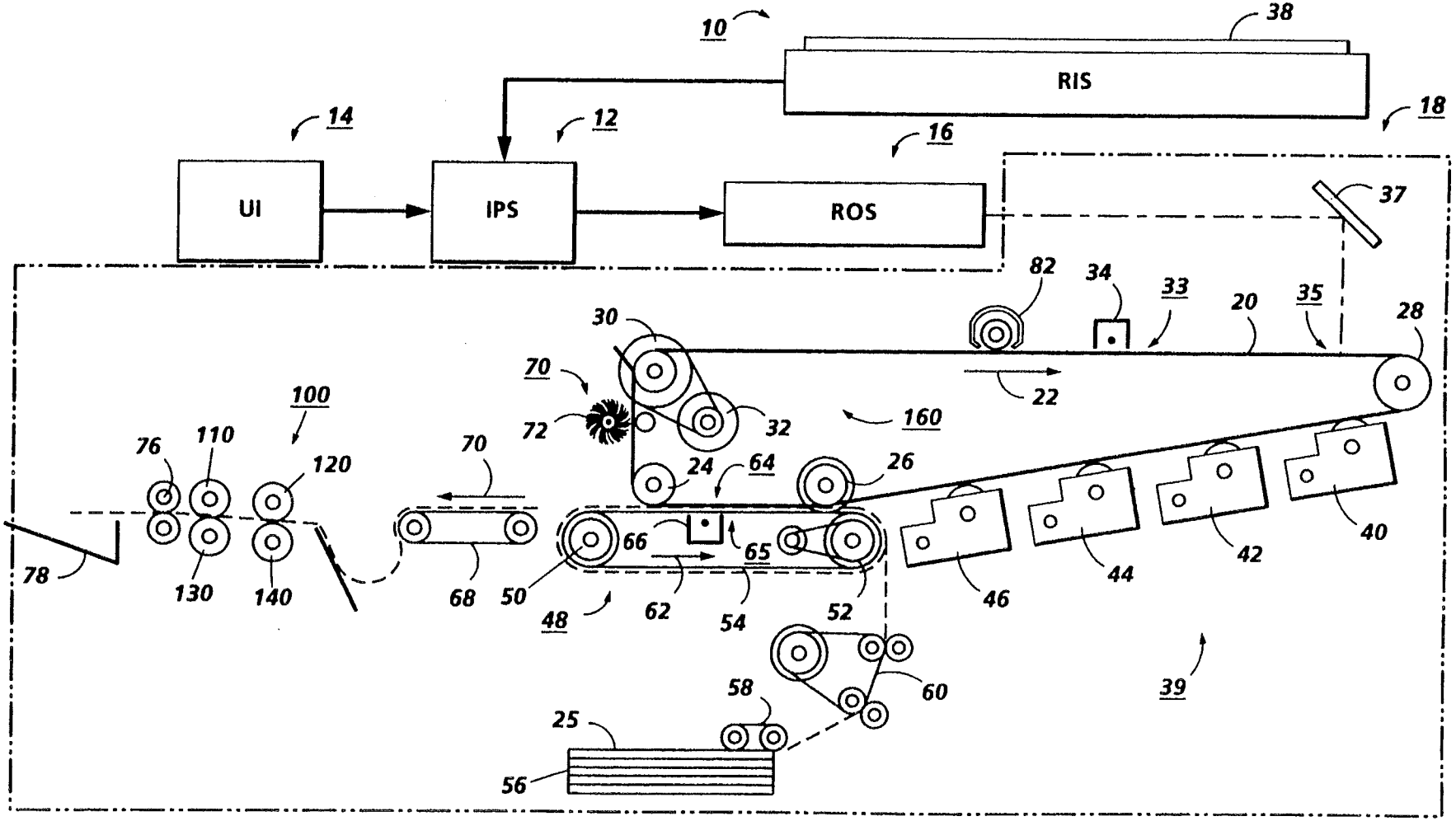
FIG. 6 is a schematic, elevational view showing an exemplary color electrophotographic printing machine which may incorporate the features of the present invention therein.

To begin by way of general explanation, FIG. 6 is a schematic elevational view showing an electrophotographic printing machine which may incorporate features of the present invention therein. It will become evident from the following discussion that the present invention is equally well suited for use in a wide variety of copying and printing systems, and is not necessarily limited in its application to the particular system shown herein. As shown in FIG. 6, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. U114 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three or four latent images which correspond to the signals transmitted from IPS 12. One latent image is developed with cyan developer material. Another latent image is developed with magenta developer material and the third latent image is developed with yellow developer material. A black latent image may be developed in lieu of or in addition to other (colored) latent images. These developed images are transferred to a copy sheet in superimposed registration with one another to form a multicolored image on the copy sheet. This multicolored image is then fused to the copy sheet forming a color copy.

With continued reference to FIG. 6, printer or marking engine 18 is an electrophotographic printing machine. Photoconductive belt 20 of marking engine 18 is preferably made from a photoconductive material. The photoconductive belt moves in the direction of arrow 22 to advance successive portions of the photoconductive surface sequentially through the various processing stations disposed about the path of movement thereof. Photoconductive belt 20 is entrained about rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three or four times to record three or four latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the complement of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (not shown in FIG. 6) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 (not shown in FIG. 6) to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a gas directing mechanism 100 directs a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three or four different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolored copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 100, where the transferred toner image is permanently fused to the sheet. The fusing station includes heated fuser rolls 110 and 120 and pressure rolls 130 and 140. The sheet passes through the nip defined by rolls 120 and 140 and/or the nip defined by rolls 110 and 130. The toner image is contacted by one or both sets of fuser rolls so as to be affixed to the sheet, as described in greater detail in association with FIGS. 1 and 2. (Other variations of the multiple level fusers of the present invention are shown and described in conjunction with FIGS. 3A, 3B, 4, 5A and 5B.) Thereafter, the sheet is advanced by a pair of rolls 76 to a catch tray 78 for subsequent removal therefrom by the machine operator.

The final processing station in the direction of movement of belt 20, as indicated by arrow 22, is a photoreceptor cleaning apparatus, indicated generally by the reference numeral 70. A rotatably mounted fibrous brush 72 may be positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

FIG. 1 shows multilevel fuser 100 of the present invention employing a first level set of fuser roller 110 opposed by pressure roller 130 and a second level set of fuser roller 120 opposed by pressure roller 140. Fuser roller 110 is mounted on bracket 114 of mounting assembly 102; roller 110 is mounted on axle 112. FIG. 1 is an elevational view showing one side of fuser 100; an opposite side of fuser 100 is a mirror image of the side shown in FIG. 1, and operates the same as the side shown in FIG. 2, as detailed below. When the set of fusing roller 110 and pressure roller 130 engage the sheet, rotational force to pull the sheet through the nip may be supplied by one or more motors (not shown) coupled to axles 112 and/or 132. Depending on the drive means selected, the fusing and pressure roller axles shown in each embodiment of the present invention may rotate or remain stationary.

Figure 2:
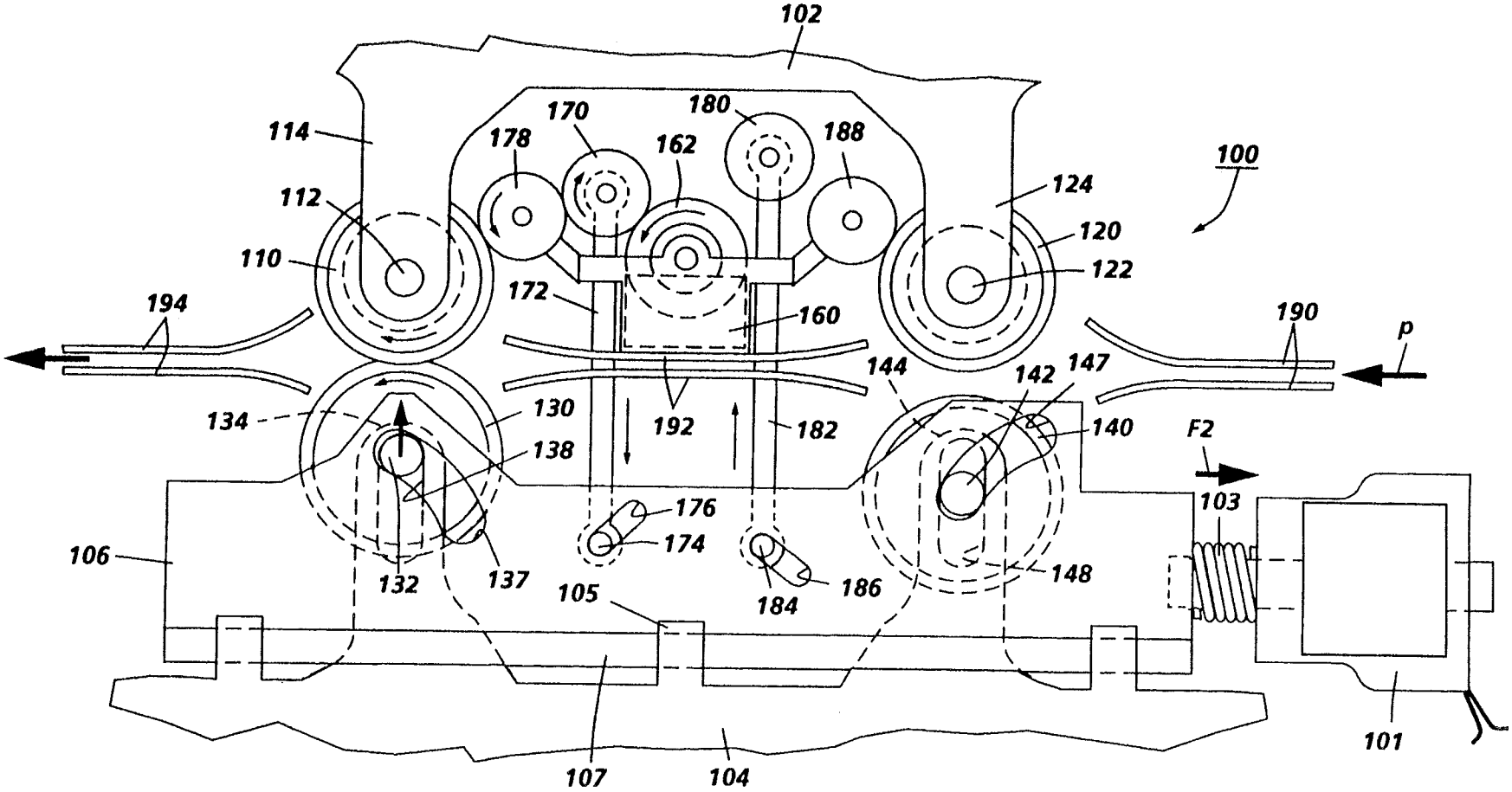
FIG. 2 is an elevation view of another embodiment of the fusing assembly of the present invention.

When the first level set of fuser roller 110 opposed by pressure roller 130 are moved into the sheet path (as shown in FIG. 2) or preparing to engage the sheet, the outer surface of fusing roller 110 is heated so as to apply the requisite heat for fusing the toned image to that sheet. Pressure roller 130 is shown in FIG. 1 in disengaged (non-fusing) position; no movement of fuser roller 110 is required, nor is the sheet path changed by engaging rollers 110 and 130 (or 120 and 130). (Rollers 110, 120, 130 and/or 140 may also include a deformable surface coating to enhance fusing performance.) Pressure roller 130 is mounted on axle 132; when disengaged from fusing position, pressure roller 130 slides to a lower position in slot 138 of lower bracket 134, so as to permit the sheet to pass overhead without pressure contact. Lower bracket 134 is in fixed position on lower mounting assembly 104. Slide plate 106 is movably attached by rails 107 to lower mounting assembly 104 by guides 105, and is shown in FIG. 1 applying force in the direction shown by arrow F1. Slide plate 106 is moved horizontally by reversible motor 109; slide plate 106 is linked to motor 109 by drive screw 108. Motor 109 and drive screw 108 also preferably linked to the opposite slide plate by a rigid connecting bar (not shown in FIG. 1), such that a single motor is used to horizontally move both slide plates 106 in unison.

Angled slot 136 is cut into in slide plate 106, and engages one end of axle 132. When slide plate 106 is positioned as shown in FIG. 1 by motor 109, angled slot 136 forces pressure roller 130 to lower away from the sheet moving in direction P along the sheet path defined by sheet path guides 190, 192 and 194. In all cases, care must be taken to avoid smearing the untoned image prior to fusing to the sheet. The engagement of axle 132 by slot 138 in fixed bracket 134 restricts pressure roller 130 to vertical movement only. At the same time, when pressure roller 132 is lowered away from the sheet path, slot 176 in slide plate 106 causes pin 174 engaged thereby to elevate connector arm 172. The upper end of connector arm 172 engages one end of oil transfer roll 170. When the upper end of connector arm 172 is raised in this manner (as shown in FIG. 1), oil transfer roll 170 disengages from applicator roll 178 and sump roll 162, whereby the fuser oil otherwise provided to fuser roller 110 by transfer roll 178 is cut off. Oil transfer roll 170, applicator roll 178 and sump roll 162 are preferably rotated by their contact with rotating fusing roller 110.

Therefore, according to the horizontal location of slide plate 106 as positioned by drive screw 108 and motor 109, pressure roller 110 is elevated or lowered, while connector arm lowers or raises oil transfer roller 170. One set of fuser/pressure rollers may be engaged for black only copying or printing, while the other fuser/pressure rollers may be engaged for full color copying or printing. Black only copying or printing is desirably fused so as to result in a low gloss finish, generally requiring lower fusing temperature, pressure and/or dwell time.

Also as shown in FIG. 1, when fuser roller 120 opposed by pressure roller 140 engages the sheet or prepares to engage the sheet, fusing roller 120 is internally heated so that it may apply the requisite heat for fusing the toned image to that sheet. FIG. 1 shows fuser roller 120 in operating position adjacent to pressure roller 140. Fuser roller 120 is rotatably mounted by axle 122 on mounting arm 124 of fuser assembly 102, and like fuser roller 110, supplies the heat required to fix toner to the sheet passing below. Opposing fuser roller 120 and pressure roller 140, shown in FIG. 1, are in engaged (fusing) position; rollers 120 and/or 140 propel the sheet through the fusing nip by one or more motors (not shown) coupled therewith. Pressure roller 140 rotates on axle 142; when engaging the sheet in fusing position, pressure roller 140 slides to an upper position in slot 148 of lower bracket 144, so as to apply pressure at the nip with fuser roller 120, through which the sheet passes under pressure. Lower bracket 144 is in fixed position on lower mounting assembly 104. As set forth above, slide plate 106 is movably attached to lower mounting assembly 104 by guides 105, and is moved horizontally by reversible motor 109 connected to slide plate 106 by screw drive 108.

Angled slot 146 is cut into in slide plate 106, and engages one end of axle 142. When slide plate 106 is positioned as shown in FIG. 1 by motor 109, angled slot 146 forces pressure roller 142 to raise into the sheet path defined by sheet path guides 190, 192 and 194. The engagement of axle 142 by slot 148 in fixed bracket 144 restricts pressure roller 140 to vertical movement only. As pressure roller 142 is raised into the sheet path by movement of slide plate 106, slot 186 in slide plate 106 causes pin 184 engaged thereby to lower connector arm 182. The upper end of connector arm 182 engages one end of oil transfer roll 180. When the upper end of connector arm 172 is raiseded (as shown in FIG. 1), oil transfer roll 170 disengages applicator roll 178 and sump roll 162, whereby the fuser oil ceases to provide to fuser oil to roller 120. In recapitulation, as shown in FIG. 1, according to the position of slide plate 106, pressure roller 140 engages fusing roller 120 so as to form the pressure nip through which the sheet passes, while pressure roller 130 is lowered away from the sheet path.

FIG. 2 shows the multilevel fuser 100 of the present invention substantially as shown in FIG. 1, wherein slide plate 106 has been repositioned so that the second level fusing set is moved into the sheet path at the nip formed by pressure roller 130 and fusing roller 110, while pressure roller 140 is lowered away from the sheet path so as to disengage pressure roller 140 from contact with fuser roller 120. When fusing roller 110 and pressure roller 130 engage the sheet, rotational force to pull the sheet through the nip may be supplied to fusing roller 110 and pressure roller 130 by one or two motors (not shown) coupled to axles 112 and/or 132 (this same motor or motors may also be coupled to axles 122 and/or 142 for pulling the sheet through fusing roller 120 and pressure roller 140 when they are engaged).

In addition to showing this reversed fusing set engagement from that shown in FIG. 1, FIG. 2 also shows the use of curved slots 137 and 147 in place of angled slots 136 and 146 as shown in FIG. 1. Curved slot 137 is cut into in slide plate 106, and engages one end of axle 132. Slide plate 106 is positioned as shown in FIG. 2 by rails 107 mating with guides 105 by solenoid 101; optional spring 103 may provide a biasing force opposite the F2 force shown in FIG. 2, so as to increase the pressure applied when pressure roller 130 is elevated to contact fusing roller 110. According to movement of slide plate 106 by solenoid 101, curved slot 137 forces pressure roller 130 to move into contact with a sheet moving in direction P along the sheet path defined by sheet path guides 190, 192 and 194. Pressure roller 130 thereby slides to an elevated position in slot 138 of lower bracket 134; axle 132 is also prevented from moving horizontally by slot 138 of lower bracket 134.

FIG. 2 also shows fuser roller 120 in non-operating position, as pressure roller 140 is pulled away from the sheet path defined by sheet path guides 190, 192 and 194. The path of the sheet does not substantially change, regardless of the position of pressure roller 140 (or 130). Pressure roller 140 rotates on axle 142; curved slot 147 is cut into in slide plate 106, and engages one end of axle 142. When slide plate 106 is positioned as shown in FIG. 2 by solenoid 101, curved slot 147 forces axle 142 of pressure roller 140 to be lowered from the sheet path; axle 142 is prevented from moving horizontally by slot 148 of lower bracket 144, which is fixed to lower mounting assembly 104.

Also as shown in FIG. 2, when pressure roller 130 is raised into the sheet path, slot 176 in slide plate 106 causes pin 174 to lower connector arm 172. The upper end of connector arm 172 engages one end of oil transfer roll 170; when the upper end of connector arm 172 is lowered, oil transfer roll 170 engages applicator roll 178 and sump roll 162, whereby fuser oil is provided to fuser roller 110 by transfer roll 178. As pressure roller 140 is lower away from the sheet path, slot 186 in slide plate 106 causes pin 184 engaged thereby to raise connector arm 182. The upper end of connector arm 182 engages one end of oil transfer roll 180; when the upper end of connector arm 182 is raised (as shown in FIG. 2), oil transfer roll 180 disengages applicator roll 188 and sump roll 162, whereby the supplying of fuser oil to fusing roller 120 is cut off.

When a linear or constant force is desired to raise or lower pressure rollers 130 and 140, angled slots 136 and 146 as shown in FIG. 1 are utilized. The use of angled slots permits the uniform application of force across the width of the fusing nip of either set of fusing/pressure rollers. The angle of these slots may be varied; a steeper angled slot relative to the horizontal plane will cause the pressure rollers to quickly move away or towards the paper path upon movement of slide plate 106. A less steep angle of these slots relative to the horizontal plane will cause the pressure rollers to move slowly away or towards the paper path upon movement of slide plate 106; this less steep angle will also permit greater force to be applied at the fusing nip, as greater leverage is attained as the pressure roller axles ride up along a more gentle slope. The angle of each slot at the end of a pressure roller need only be the same so as to apply even force across the span of that nip; the angle of the slot 136 used to raise and lower pressure roller 130 need not be the same as the angle of the slot 146 used to raise and lower pressure roller 140; in this manner, these alternatively employed pressure rollers may be used to create different pressure ranges at the fusing nip, as described above.

When a nonlinear or graduated force is desired to raise or lower pressure rollers 130 and 140, curved slots 137 and 147 as shown in FIG. 2 may be utilized. The use of curved slots permits the increased application of force at the fusing nip of either set of fusing/pressure rollers. The curve of these slots may be varied; a curved slot that follows and increasingly gentle slope relative to the horizontal plane as it nears the upper end of that slot to apply gradually increasing pressure at the nip, while using the same or less force as applied by solenoid 101. Increased leverage at the pressure nip can thereby be attained as the pressure roller axles ride up along this increasingly gentle slope formed by curved slots 137 and 147. Although the curve of each curved slot (137 or 147) in one slide plate at the end of a pressure roller must match the corresponding curve of the slot in the opposite slide plate at the other end of a pressure roller same so as to apply even force across the span of that nip, each set may employ a different curve, just as with ,the angles of angled slots 136 and 146 as shown in FIG. 1. Further, one pressure roller in the same fuser may engage a set of curved slots (137 or 147) at each end, while the other pressure roller in the same fuser may engage angled slots (136 or 146) at each end; in this manner, these alternatively employed pressure rollers may be used to create different pressure ranges and performance characteristics at the fusing nip. Further, vertical slots may be formed on the sliding plates and angled or curved slots formed in the fixed plates, such that like the embodiments shown in FIGS. 1, 2 and 4, the fusing (or pressure) rollers are raised and lowered by horizontal movement of the sliding plates. Sliding axle bearing inserts (not shown) may also be employed in each axle slot in the embodiments shown in FIGS. 1, 2 and 4, such that the axles may slide smoothly within vertical, angled and curved slots, while reducing rotational friction. The axles may rotate or be stationary, depending on the fusing and pressure roller drive means selected.

In the various embodiments employing curved slots 137 and 147 or angled slots 136 and 146, motor 109 or solenoid 101 are preferably configured so as to apply a force to slide plate 106 that can be altered, so that depending on the sheet composition and thickness, toner characteristics, fusing pressure, fusing temperature, dwell time and other factors, the fusing pressure, dwell time and heat applied to the toned image being fixed to the sheet can be widely varied.

The multilevel fuser of the present invention may be employed to fuse toner to transparencies or paper, thick sheets or thin sheets, coated or uncoated papers, and virtually any other variance of substrate. Fuser oil may be supplied to both fuser rollers. The embodiment of the present invention shown in FIG. 2 permits one set of fuser/pressure rollers to be engaged for black only copying or printing, so as to result in a low gloss finish at a lower fusing temperature, lower pressure and/or shorter dwell time. The embodiment shown in FIG. 2 also permits both sets of fuser/pressure rollers to be engaged for full color copying or printing, when the toned sheet is fused so as to result in a high gloss finish, generally requiring a higher fusing temperature, a higher pressure and/or a longer dwell time. For example, in certain other fusing applications, single level fusers may cause the entire printer or copier process speed to be slowed when colored prints or transparencies are fused. The embodiments of the present invention, each fusing roller can be preheated and maintained at a different temperature or temperature range. The fuser/pressure roller sets can be quickly engaged and disengaged without altering the sheet path, a particularly important feature when the sheets being fused move at higher speeds along the sheet path, with reduced likelihood of sheet jamming and misfeeds. The fusers of the present invention can quickly shift to fuse cover stock, transparencies, plain paper or other sheet combinations, without delay, changes in overall process speed, or fuser roll temperature. The multilevel fuser of the present invention may fuse a variety of combinations of single or multicolored toners, at differing temperature and pressure levels. A manually operated lock switch or screw, a thumbwheel, a cam, a pneumatic pressure valve or other method may be used like solenoid 101 or motor 109 to position slide plates 106 without departing from the spirit of the present invention.

Figure 3A:
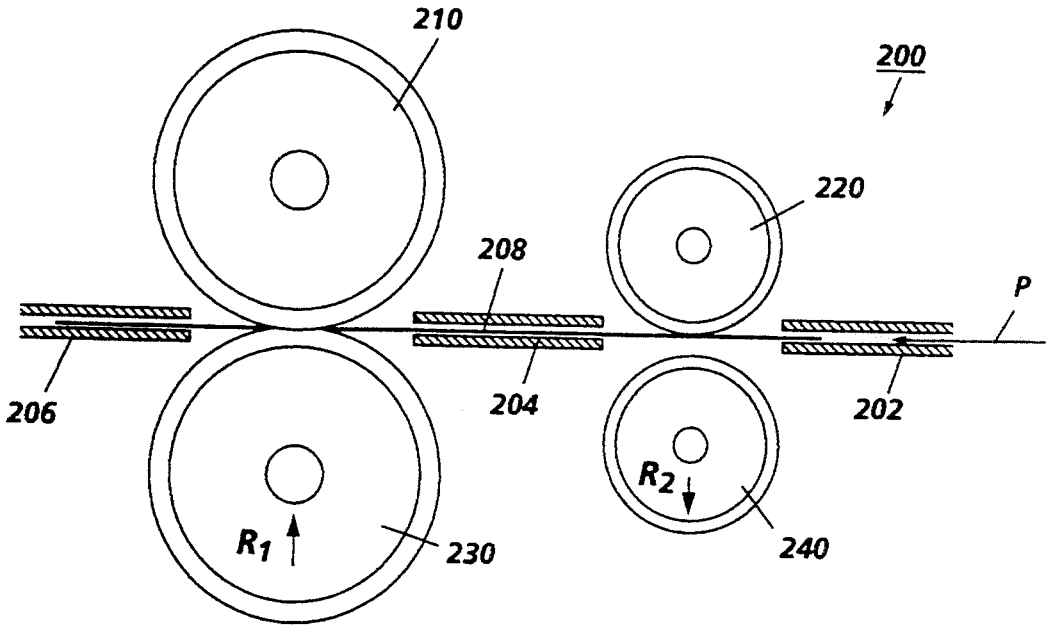
FIG. 3A is a schematic, elevational view of an embodiment of a fusing assembly of the present invention.
Figure 3B:
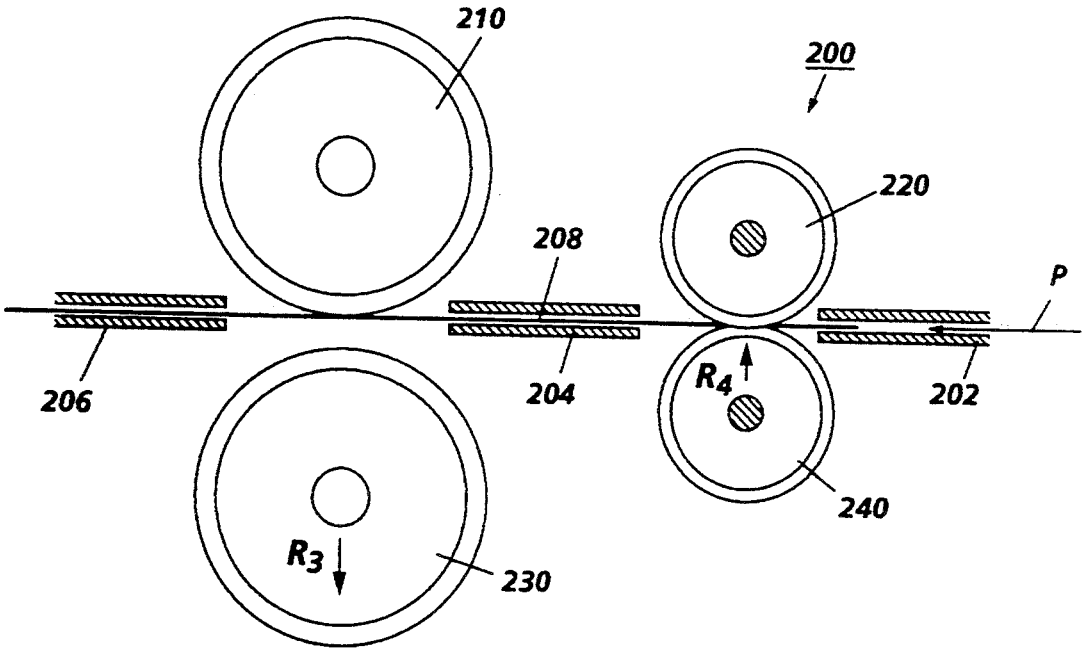
FIG. 3B is a schematic, elevational view of the fusing assembly shown in FIG. 3A.

FIGS. 3A and 3B show schematic views of a sheet passing through a four roller fuser 200 of the present invention. Additional sets of fuser/pressure rollers may be employed according to the embodiments shown in each Figure herein, without departing from the spirit of the present invention.

FIG. 3A shows a sheet 208 moving in direction P through sheet guides 202, 204, and 206. Fuser roller 210 is shown in operative position with pressure roller 230, forming a nip through which the sheet passes. Force is applied in the direction shown by arrow R1 to pressure roller 230 to fix the toned image to sheet 208. As shown in FIGS. 3A and 3B, fuser roller 210 and pressure roller 230 may have greater diameters than fuser roller 220 and pressure roller 240, so as to achieve increased fusing dwell time or to otherwise vary the performance characteristics of each fuser/pressure roller set. Pressure roller 240 is shown disengaged from fusing position in FIG. 3A, lowered away from fusing roller 220. Force R2 applied in the direction shown to pressure roller 240 to prevent this set of fuser pressure rollers from engaging the sheet.

FIG. 3B also shows sheet 208 moving in direction P through sheet guides 202,204, and 206. Fuser roller 210 is shown in nonoperative position with pressure roller 230; force is applied in the direction of arrow R3 as shown to pressure roller 230 to prevent this set of fuser and pressure rollers from engaging the sheet. Fuser roller 220 is shown in operative position with pressure roller 240, forming a nip through which the sheet passes. Force is applied in the direction shown by arrow R4 to pressure roller 240 to fix the toned image to sheet 208.

Figure 4:
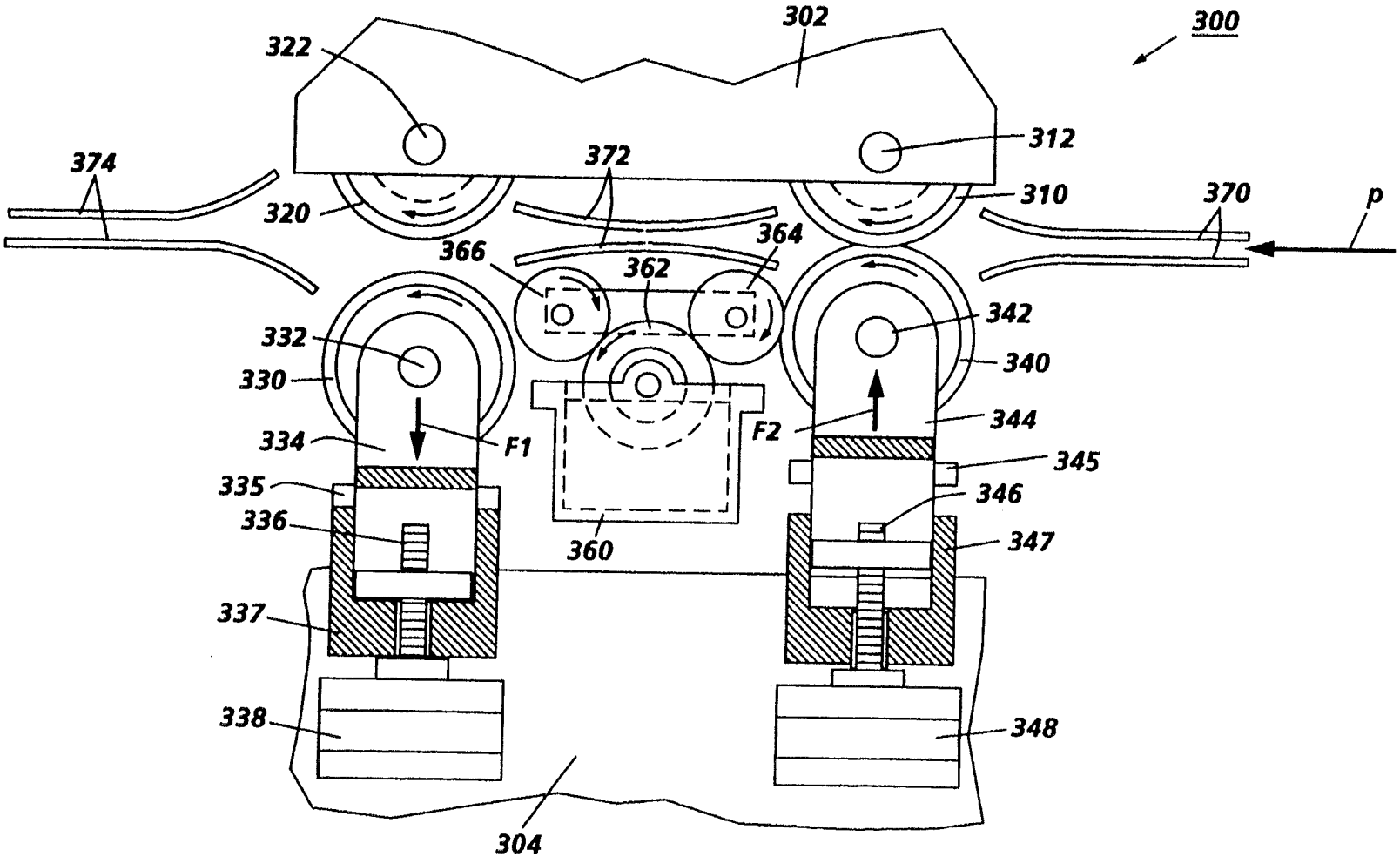
FIG. 4 is a elevational view, partially in section, of another embodiment of a fusing assembly of the present invention.

FIG. 4 shows one side of another embodiment of the multilevel fuser of the present invention employing independently engagable fusing/pressure roller sets, the opposite side being a mirror image of the side shown. In the first level fusing set, stationary pressure roller 320 is opposed by selectively engagable, variably heated fusing roller 330; in the second level fusing set, pressure roller 310 is opposed by selectively engagable, variably heated fusing roller 340; additional sets of fusing/pressure rollers (not shown) may be likewise employed in tandem with the fusing roller sets shown in FIGS. 1, 2 and/or 4.

Fuser roller 330 is mounted by axle 332 on bracket 334; stops 335 prevent bracket 334 from retracting too far into bracket holder 336. Screw member 336 passes through bracket holder 337, and mates with a threaded portion of bracket 334. Motor 338 and bracket 334 are mounted to lower mounting member 304. Variable direction motor 338 rotates screw member 336 so as to move fusing roller towards or away from the sheet path defined by sheet guides 370, 372 and 374. FIG. 4 is an elevational view showing one side of fuser 300; an opposite side of fuser 300 is a mirror image of the side shown in FIG. 4, and operates the same as the side shown in FIG. 4. Motor 338 is preferably linked to the opposite bracket 334 (not shown in FIG. 4), such that a single motor is used to move both brackets 334 in raising roller 330. Motor 338 is shown in FIG. 4 applying a variable force F1 to fusing roller 330 in the direction shown. When the set of fusing roller 330 and pressure roller 320 engage the sheet (not shown in FIG. 4), rotational force to pull the sheet through the nip may be supplied by one or two motors (also not shown) coupled to axles 332 and/or 322.

Fuser roller 340 is mounted by axle 342 on bracket 344; stops 345 prevent bracket 344 from retracting too far into bracket holder 347. Screw member 346 passes through bracket holder 347, and mates with a threaded portion of bracket 344. Variable direction motor 348 rotates screw member 346 so as to move fusing roller towards or away from the sheet path defined by sheet guides 370, 372 and 374. Motor 348 and bracket 344 are mounted to lower mounting member 304. Again, FIG. 4 is an elevational view showing one side of fuser 300; an opposite side of fuser 300 is a mirror image of the side shown in FIG. 4, and operates the same as the side shown in FIG. 4. Motor 348 is also preferably linked to the opposite bracket 344 (not shown in FIG. 4), such that a single motor is used to move both brackets 344 in raising roller 340. Motor 338 is shown in FIG. 4 applying a variable force F2 to fusing roller 340 in the direction shown. When the set of fusing roller 340 and pressure roller 310 engage the sheet, rotational force to pull the sheet through the nip may be supplied by one or two motors (not shown) coupled to axles 342 and/or 312.

Fuser oil well 360 supplies fuser oil to both fuser rollers 330 and 340. In an alternative embodiment (not shown) the fuser supply system may be omitted, or activated selectively without regard to pressure roller position. When fusing roller 330 is elevated, it contacts oil transfer roller 366; oil transfer roller 366 is supplied by well roller 362. When fusing roller 330 is lowered as shown in FIG. 4 roller 330 also withdraws from contact with oil transfer roller 366, thereby halting the supply of fusing oil. When fusing roller 340 is elevated as shown in FIG. 4, it contacts oil transfer roller 364; oil transfer roller 364 is supplied with fuser oil from well roller 362, which draws oil from fuser oil well 360. When fusing roller 340 is lowered, it withdraws from contact with oil transfer roller 366. The aforementioned rollers employed to provide fuser oil to the fuser rollers are configured so as to rotate in the direction of the arrows shown on each roller. The present configuration results in well roller 362 being urged to rotate one direction by both fusing rollers even when both fuser rollers are raised so as to engage a sheet passing along the sheet path. In alternative embodiments (not shown) fuser oil may be selectively applied to the fuser rollers independent of the position or movement of those fuser rollers, by solenoids or motors moving the transfer rollers.

The fuser embodiment shown in FIG. 4 may also utilize independently controlled curved or angled slot and pin mechanisms such as are used to raise and lower the pressure rollers, like shown in FIGS. 1 and 2. According to a horizontal location of a slide plate as positioned by drive screw and motor mechanisms as shown in FIGS. 1 and 2, fusing rollers 330 and 340 may be independently raised or lowered.

Fusing rollers 330 and 340 may be raised and lowered independently or together so as to engage or disengage a sheet passing through the fusing nips. In one embodiment of the present invention as shown in Figure, one set of fuser/pressure rollers to be engaged for black only copying or printing, so as to result in a low gloss finish at a lower fusing temperature, lower pressure and/or shorter dwell time. The embodiment shown in FIG. 4 also permits both sets of fuser/pressure rollers to be engaged for full color copying or printing, when the toned sheet is fused so as to result in a high gloss finish, generally requiring a higher fusing temperature, a higher pressure and/or a longer dwell time. The RIS 10 and/or the IPS 12 as shown in FIG. 6 can be used to manually or automatically select among the possible fusing roller, temperature, pressure, dwell time, and other fusing parameters for each embodiment of the present invention, to include by automatically detecting the colors in an original document, so as to actuate the various possibilities of the embodiments of the fusers shown in FIGS. 1 through 6. UI 14 as shown in FIG. 6 can also be used to manually or automatically select among the possible fusing roller, temperature, pressure, dwell time, and other fusing parameters for each embodiment of the present invention operating the translating member and the heated fusing and pressure rollers. The input scanner for detecting the colors in an original document so as to operate said translating member and said heated and pressure rollers. When the original document is in electronic form, the printing machine may also automatically detect the colors in an original document so as to actuate the various possibilities of the embodiments of the fusers shown and described herein. A sensor for detecting the type and characteristics of the sheets onto which the image is to fused (not shown) may also actuate the various possibilities of the embodiments of the fusers shown and described herein at some point along the sheet path prior to fuser 100 in as shown in FIG. 6.

Figure 5A:
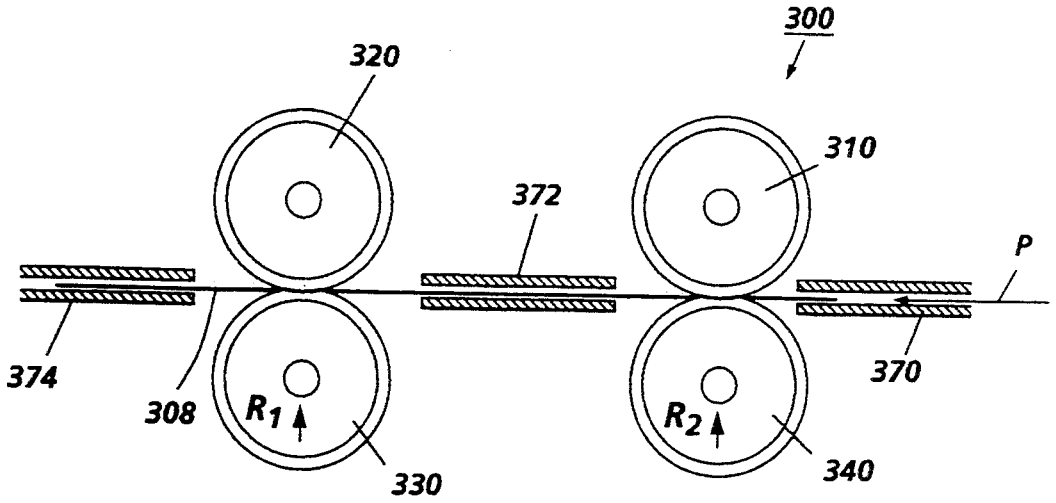
FIG. 5A is a schematic, elevational view of the fusing assembly shown in the FIG. 4 embodiment of a fusing assembly of the present invention.

FIG. 5A shows fuser 300 as shown in FIG. 4. Fuser 300 is shown having a sheet 308 moving in direction P through the sheet path defined by sheet guides 370, 372 and 374. Fuser roller 330 is shown in operative position with pressure roller 320, forming a nip through which the sheet passes. Force is applied in the direction shown by arrow R1 to fuser roller 330 to fix the toned image to sheet 308. Fuser roller 340 is also shown engaged in fusing position in FIG. 5A, forming a nip with pressure roller 2110. Force R2 applied in the direction shown to fuser roller 340 causes it to form a nip with pressure roller 2110 to engage the sheet.

Figure 5B:
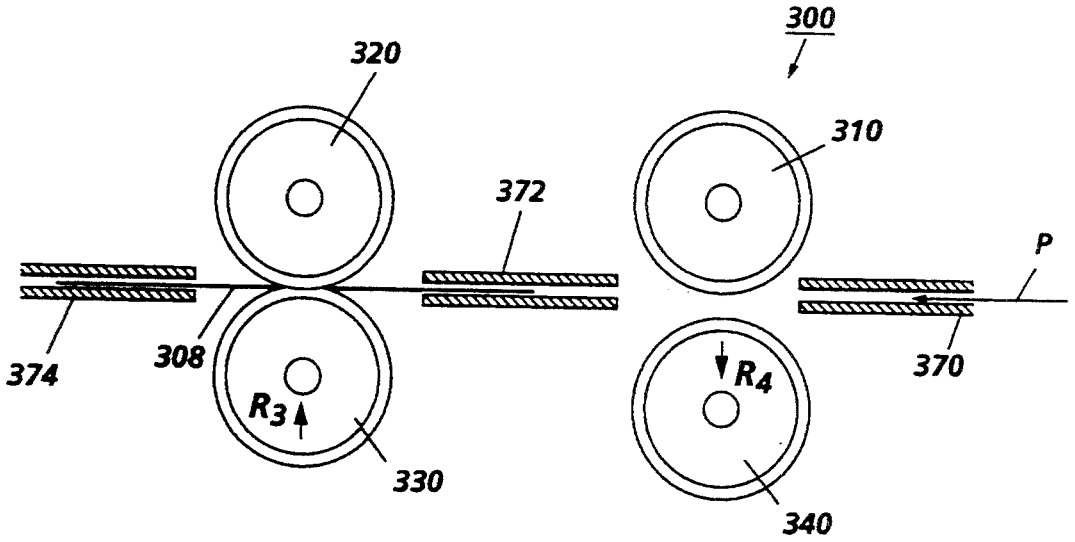
FIG. 5B is a schematic, elevational view of the fusing assembly shown in the FIG. 4 embodiment of a fusing assembly of the present invention.

FIG. 5B also shows is a schematic view of the fuser 300 as shown in FIG. 4. Fuser 300 is shown having a sheet 308 moving in direction P through the sheet path defined by sheet guides 370, 372 and 374. Fuser roller 330 is shown in operative position with pressure roller 320, forming a nip through which the sheet passes. Force is applied in the direction shown by arrow R3 to fuser roller 330 to fix the toned image to sheet 308. Fuser roller 340 is also shown disengaged from fusing position in FIG. 5B; force R4 applied in the direction shown causes fuser roller 340 to withdraw from the sheet path.

Various embodiments of a multilevel fusing system employing multiple heat/pressure roller sets with variable performance characteristics have been described. While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. An apparatus for fusing a single toner image or a plurality of toner images on a sheet passing along a sheet path, comprising:

a first heated roller;

a first pressure roller;
a second heated roller;
a second pressure roller;
a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the .plurality of toner images thereon passing through the first nip and the second nip, said first and second heated rollers being substantially non-translatable relative to the sheet path and said first and second pressure rollers being translatable relative to the sheet path; and
a fuser oil well, wherein translation of said first pressure roller into said sheet path provides a substantially uniformly distributed supply of fuser oil to said first heated roller from said fuser oil well and wherein translation of said second pressure roller into said sheet path provides a substantially uniformly distributed supply of fuser oil to said second heated roller from said fuser oil well.

2. An apparatus for fusing a single toner image or a plurality of toner images on a sheet passing along a sheet path, comprising:
a first heated roller;
a first pressure roller;
a second heated roller;
a second pressure roller;
a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, said first and second heated rollers being translatable relative to the sheet path and said first and second pressure rollers being substantially non-translatable relative to the sheet path; and
a fuser oil well, wherein translation of said first heated roller into said sheet path provides a substantially uniformly distributed supply of fuser oil to said first heated roller from said fuser oil well and wherein translation of said second heated roller into said sheet path provides a substantially uniformly distributed supply of fuser oil to said second heated roller from said fuser oil well.

3. An apparatus for fusing a single toner image or a plurality of toner images on a sheet, comprising:
a first heated roller;
a first pressure roller;
a second heated roller;
a second pressure roller;
a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet positioning said first heated roller and said first pressure roller to define the first nip and said second heated roller and said second pressure roller to define a second nip with the sheet having the plurality of toner images thereon passing through the first nip and the second nip, whereby when said translating member moves said first pressure roller toward said first heated roller, said second pressure roller moves away from said second heated roller and whereby when said translating member moves said first pressure roller away from said first heated roller, said second pressure roller moves toward said second heated roller.

4. An apparatus for fusing a single toner image or a plurality of toner images on a sheet, comprising:
a first heated roller;
a first pressure roller;
a second heated roller;
a second pressure roller;
a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the .plurality of toner images thereon passing through the first nip and the second nip, whereby when said translating member moves said first heated roller toward said first pressure roller, said second heated roller moves away from said second pressure roller and whereby when said translating member moves said first heated roller away from said first pressure roller, said second heated roller moves toward said second pressure roller.

5. An apparatus for fusing a single toner image or a plurality of toner images on a sheet, comprising:
a first heated roller;
a first pressure roller;
a second heated roller;
a second pressure roller;
a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, said translating member comprising at least one member selected from the group consisting of a motor, a solenoid, a spring, a screw, a thumbwheel, a cam and a lever, whereby said translating member is adapted to vary a sheet contact pressure on said sheet moving through said first and second nips.

6. An apparatus for fusing a single toner image or a plurality of toner images on a sheet passing along a sheet path, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, wherein said translating member comprises opposingly mounted first and second fixed brackets and opposingly connected first and second sliding plates each horizontally movable relative to each fixed bracket, said first and second pressure rollers mounted, respectively, on first and second axles, said first and second sliding plates each having opposing first non-vertical slots for engaging each end of the first axle of said first pressure roller and opposing second non-vertical slots for engaging the second axle of said second pressure roller, said first and second fixed brackets each having opposing first and second substantially vertical slots for engaging the first axle of said first pressure roller and opposing second substantially vertical slots for engaging the second axle of said second pressure roller, whereby selective movement of said first and second sliding plates translates said pressure rollers relative to said sheet path.

7. The apparatus of claim 6, further comprising a fuser oil applicator having first and second transfer rollers for selectively supplying fuser oil, respectively, to said first and second heated rollers, wherein:

said first and second sliding plates each have opposing third non-vertical slots for engaging a pair of first pins operably connected to said first transfer roller;

said first and second fixed plates each have opposing third substantially vertical slots for engaging said pair of first pins operably connected to said first transfer roller;

said first and second sliding plates each have opposing forth non-vertical slots for engaging a pair of second pins operably connected to said second transfer roller;

said first and second fixed plates each have opposing forth substantially vertical slots for engaging said pair of second pins operably connected to said second transfer roller, whereby when said first and second sliding plates are selectively moved, said first and second transfer rollers selectively engage said first and second heated rollers, respectively, so as to provide fuser oil to said heated rollers.

8. The apparatus of claim 6, wherein said non-vertical slots are curved so as to provide nonlinearly varied pressure at said first and second nips according to movement of said sliding plates.

9. The apparatus of claim 6, wherein said first non-vertical slots have a negative slope relative to a vertical axis and wherein said second non-vertical slots have a positive slope relative to said vertical axis.

10. An apparatus for fusing a single toner image or a plurality of toner images on a sheet passing along a sheet path, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, wherein said translating member comprises opposingly mounted first and second fixed brackets and opposingly connected first and second sliding plates each horizontally movable relative to each fixed bracket, said first and second pressure rollers mounted, respectively, on first and second axles, said first and second sliding plates each having opposing first non-vertical slots for engaging each end of the first axle of said first pressure roller and opposing second non-vertical slots for engaging the second axle of said second pressure roller, said first and second fixed brackets each having opposing first and second substantially vertical slots for engaging the first axle of said first pressure roller and opposing second substantially vertical slots for engaging the second axle of said second pressure roller, whereby selective movement of said first and second sliding plates translates said heated rollers relative to said sheet path.

11. The apparatus of claim 10, further comprising a fuser oil applicator having first and second transfer rollers, said first transfer roller being mounted adjacent to said first heated roller and said second transfer roller being mounted adjacent to said second heated roller, whereby:

said first heated roller engages said first transfer roller so as to provide fuser oil to said first heated roller when said first heated roller engages said first pressure roller in the sheet path; and said second heated roller engages said second transfer roller so as to provide fuser oil to said second heated roller when said second heated roller engages said second pressure roller in the sheet path.

12. The apparatus of claim 10, wherein said non-vertical slots are curved so as to provide nonlinearly varied pressure at said first and second nips according to movement of said sliding plates.

13. The apparatus of claim 10, wherein said first non-vertical slots have a negative slope relative to a vertical axis and wherein said second non-vertical slots have a positive slope relative to said vertical axis.

14. An apparatus for fusing a single toner image or a plurality of toner images on a sheet, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip; and an oil applicator for applying fuser oil to said heated rollers independent of movement of said heated rollers and said pressure rollers.

15. An electrophotographic printing machine having a fuser for fixing toner to a sheet, passing along a sheet path, said fuser comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, said first and second heated rollers being substantially non-translatable relative to the sheet path and said first and second pressure rollers being translatable relative to the sheet path; and a fuser oil well, wherein translation of said first pressure roller into said sheet path provides a substantially uniformly distributed supply of fuser oil to said first heated roller from said fuser oil well and wherein translation of said second pressure roller into said sheet path provides a substantially uniformly distributed supply of fuser oil to said second heated roller from said fuser oil well.

16. An electrophotographic printing machine having a fuser for fixing toner to a sheet passing along a sheet path, said fuser comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, said first and second heated rollers being translatable relative to the sheet path and said first and second pressure rollers being substantially non-translatable relative to the sheet path; and a fuser oil well, wherein translation of said first heated roller into said sheet path provides a substantially uniformly distributed supply of fuser oil to said first heated roller from said fuser oil well and wherein translation of said second heated roller into said sheet path provides a substantially uniformly distributed supply of fuser oil to said second heated roller from said fuser oil well.

17. An electrophotographic printing machine for fusing a single toner image or a plurality of toner images on a sheet, comprising:

a first heated roller;

a first pressure roller;

a second heated roller;

a second pressure roller;

a translating member, responsive to the single toner image being on the sheet, positioning said first heated roller and said first pressure roller to define a first nip in a sheet path through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, whereby when said translating member moves said first pressure roller toward said first heated roller, said second pressure roller moves away from said second heated roller and whereby when said translating member moves said first pressure roller away from said first heated roller, said second pressure roller moves toward said second heated roller.

18. An electrophotographic printing machine for fusing a single toner image or a plurality of toner images on a sheet, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, whereby when said translating member moves said first heated roller toward said first pressure roller, said second heated roller moves away from said second pressure roller and whereby when said translating member moves said first heated roller away from said first pressure roller, said second heated roller moves toward said second pressure roller.

19. An electrophotographic printing machine for fusing a single toner image or a plurality of toner images on a sheet, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, said translating member comprising at least one member selected from the group consisting of a motor, a solenoid, a spring, a screw, a thumbwheel, a cam and a lever, whereby said translating member is adapted to vary a sheet contact pressure on said sheet moving through said first and second nips.

20. An electrophotographic printing machine for fusing a single toner image or a plurality of toner images on a sheet passing along a sheet path, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, wherein said translating member comprises oppositely mounted first and second fixed brackets and opposingly connected first and second sliding plates each horizontally movable relative to each fixed bracket, said first and second pressure rollers mounted, respectively, on first and second axles, said first and second sliding plates each having opposing first non-vertical slots for engaging each end of the first axle of said first pressure roller and opposing second non-vertical slots for engaging the second axle of said second pressure roller, said first and second fixed brackets each having opposing first and second substantially vertical slots for engaging the first axle of said first pressure roller and opposing second substantially vertical slots for engaging the second axle of said second pressure roller, whereby selective movement of said first and second sliding plates translates said pressure rollers relative to said sheet path.

21. The electrophotographic printing machine of claim 20, further comprising a fuser oil applicator having first and second transfer rollers for selectively supplying fuser oil, respectively, to said first and second heated rollers, wherein:

said first and second sliding plates each have opposing third non-vertical slots for engaging a pair of first pins operably connected to said first transfer roller;

said first and second fixed plates each have opposing third substantially vertical slots for engaging said pair of first pins operably connected to said first transfer roller;

said first and second sliding plates each have opposing forth non-vertical slots for engaging a pair of second pins operably connected to said second transfer roller;

said first and second fixed plates each have opposing forth substantially vertical slots for engaging said pair of second pins operably connected to said second transfer roller, whereby when said first and second sliding plates are selectively moved, said first and second transfer rollers selectively engage said first and second heated rollers, respectively, so as to provide fuser oil to said heated rollers.

22. The electrophotographic printing machine of claim 20, wherein said non-vertical slots are curved so as to provide nonlinearly varied pressure at said first and second nips according to movement of said sliding plates.

23. The electrophotographic printing machine of claim 20, wherein said first non-vertical slots have a negative slope relative to a vertical axis and wherein said second non-vertical slots have a positive slope relative to said vertical axis.

24. An electrophotographic printing machine for fusing a single toner image or a plurality of toner images on a sheet passing along a sheet path, comprising:

a first heated roller;

a first pressure roller;

a second heated roller;

a second pressure roller;

a translating member, responsive to the single toner image being on the sheet, positioning said first heated roller and said first pressure roller to define a first nip through which the sheet having the single toner image thereon passes with said second heated roller and said second pressure roller being spaced apart from one another, said translating member, responsive to the plurality of toner images being in the sheet, positioning said first heated roller and said first pressure roller to define the first nip and said second heated roller and said second pressure roller to define a second nip with the sheet having the plurality of toner images thereon passing through the first nip and the second nip, wherein said translating member comprises opposingly mounted first and second fixed brackets and opposingly connected first and second sliding plates each horizontally movable relative to each fixed bracket, said first and second pressure rollers mounted, respectively, on first and second axles, said first and second sliding plates each having opposing first non-vertical slots for engaging each end of the first axle of said first pressure roller and opposing second non-vertical slots for engaging the second axle of said second pressure roller, said first and second fixed brackets each having opposing first and second substantially vertical slots for engaging the first axle of said first pressure roller and opposing second substantially vertical slots for engaging the second axle of said second pressure roller, whereby selective movement of said first and second sliding plates translates said heated rollers relative to said sheet path.

25. The electrophotographic printing machine of claim 24, further comprising a fuser oil applicator having first and second transfer rollers, said first transfer roller being mounted adjacent to said first heated roller and said second transfer roller being mounted adjacent to said second heated roller, whereby:

said first heated roller engages said first transfer roller so as to provide fuser oil to said first heated roller when said first heated roller engages said first pressure roller in the sheet path; and said second heated roller engages said second transfer roller so as to provide fuser oil to said second heated roller when said second heated roller engages said second pressure roller in the sheet path.

26. The electrophotographic printing machine of claim 24, wherein said non-vertical slots are curved so as to provide nonlinearly varied pressure at said first and second nips according to movement of said sliding plates.

27. The electrophotographic printing machine of claim 24, wherein said first non-vertical slots have a negative slope relative to a vertical axis and wherein said second non-vertical slots have a positive slope relative to said vertical axis.

28. An electrophotographic printing machine having a fuser for fixing toner to a sheet, said fuser comprising:

a first heated roller;

a first pressure roller;

a second heated roller;

a second pressure roller;

a translating member, responsive to the single toner image being on the sheet, positioning said first heated roller and said first pressure roller to define a first nip in a sheet path through which the sheet having the single toner image thereon passes with said second heated roller and said second pressure roller being spaced apart from one another, said translating member, responsive to the plurality of toner images being on the sheet, positioning said first heated roller and said first pressure roller to define the first nip and said second heated roller and said second pressure roller to define a second nip with the sheet having the plurality of toner images thereon passing through the first nip and the second nip; and an oil applicator for applying fuser oil to said heated rollers independent of movement of said heated rollers and said pressure rollers.

29. An electrophotographic printing machine having a fuser for fixing toner to a sheet passing along a sheet path, said fuser comprising:

a first heated roller;

a first pressure roller;

a second heated roller;

a second pressure roller;

a translating member, responsive to the single toner image being on the sheet, positioning said first heated roller and said first pressure roller to define a first nip in a sheet path through which the sheet having the single toner image thereon passes with said second heated roller and said second pressure roller being spaced apart from one another, said translating member, responsive to the plurality of toner images being on the sheet, positioning said first heated roller and said first pressure roller to define the first nip and said second heated roller and said second pressure roller to define a second nip with the sheet having the plurality of toner images thereon passing through the first nip and the second nip; and a user interface for operating said translating member and said heated and pressure rollers in fixing said toner to said sheet.

30. An electrophotographic printing machine having a fuser for fixing toner to a sheet, said fuser comprising:

a first heated roller;

a first pressure roller;

a second heated roller;

a second pressure roller;

a translating member, responsive to the single toner image being on the sheet, positioning said first heated roller and said first pressure roller to define a first nip in a sheet .path through which the sheet having the single toner image thereon passes with said second heated roller and said second pressure roller being spaced apart from one another, said translating member, responsive to the plurality of toner images being on the sheet, positioning said first heated roller and said first pressure roller to define the first nip and said second heated roller and said second pressure roller to define a second nip with the sheet having the plurality of toner images thereon passing through the first nip and the second nip; and an input scanner for detecting the colors in an original document so as to operate said translating member and said heated and pressure rollers in fixing said toner to said sheet.

31. An electrophotographic printing machine having a fuser for fixing toner to a sheet, said fuser comprising:

a first heated roller;

a first pressure roller;

a second heated roller;

a second pressure roller;

a translating member, responsive to the single toner image being on the sheet, positioning said first heated roller and said first pressure roller to define a first nip in a sheet path through which the sheet having the single toner image thereon passes with said second heated roller and said second pressure roller being spaced apart from one another, said translating member, responsive to the plurality of toner images being on the sheet, positioning said first heated roller and said first pressure roller to define the first nip and said second heated roller and said second pressure roller to define a second nip with the sheet having the plurality of toner images thereon passing through the first nip and the second nip; and a sensor for detecting a set of characteristics of the sheet so as to operate said translating member and said heated and pressure rollers in fixing said toner to said sheet.

* * * * *